US009968809B2

(12) United States Patent
Ryu et al.

(10) Patent No.: US 9,968,809 B2
(45) Date of Patent: May 15, 2018

(54) PORTABLE AIR PURIFIER

(71) Applicant: EMW ENERGY CO., LTD., Seoul (KR)

(72) Inventors: Byung Hoon Ryu, Seoul (KR); Jae Kyung Kong, Seoul (KR)

(73) Assignee: REKRIX CO., LTD., Seoul (KR)

( * ) Notice: Subject to any disclaimer, the term of this patent is extended or adjusted under 35 U.S.C. 154(b) by 610 days.

(21) Appl. No.: 14/410,088

(22) PCT Filed: Jun. 19, 2013

(86) PCT No.: PCT/KR2013/005411
§ 371 (c)(1),
(2) Date: Dec. 21, 2014

(87) PCT Pub. No.: WO2013/191468
PCT Pub. Date: Dec. 27, 2013

(65) Prior Publication Data

US 2015/0321030 A1 Nov. 12, 2015

(30) Foreign Application Priority Data

Jun. 21, 2012 (KR) ..... 10-2012-0066578

(51) Int. Cl.
*A62B 23/02* (2006.01)
*A62B 7/10* (2006.01)
(Continued)

(52) U.S. Cl.
CPC ..... *A62B 23/025* (2013.01); *A62B 7/10* (2013.01); *A62B 9/003* (2013.01); *A62B 18/006* (2013.01);
(Continued)

(58) Field of Classification Search
CPC ..... A62B 7/10; A62B 9/03; A62B 18/02–18/025; A62B 18/06; A62B 19/00;
(Continued)

(56) References Cited

U.S. PATENT DOCUMENTS 3,731,678 A * 5/1973 Pyzel ..... A62B 23/02 128/202.26
4,502,876 A * 3/1985 Behnke, Jr. ..... A62B 19/00 55/516
(Continued)

FOREIGN PATENT DOCUMENTS

CN 104394940 A 3/2015
EP 2865425 A1 4/2015
(Continued)

OTHER PUBLICATIONS

International Search Report for PCT/KR2013/005411.

*Primary Examiner* — Valerie L Woodward
(74) *Attorney, Agent, or Firm* — The PL Law Group, PLLC

(57) ABSTRACT

Provided is a portable air purifier, which includes: a mask part; a first connecting hose having one end connected to the mask part; a second connection hose in which the first connection hose is installed, and at least part of which has an opening for introducing external air; an air purification module that purifies the introduced external air to a predetermined temperature condition and discharges the purified air to the first connecting hose; and a power supply unit configured to supply power to the heater. Since the air purification module for removing poisonous gases or biochemical pollutants through a catalytic reaction of a metal catalyst layer can be semi-permanently used, the conventional inconvenience of carrying an extra canister is removed.

5 Claims, 5 Drawing Sheets

(51) Int. Cl.

| | |
|---|---|
| ***A62B 9/00*** | (2006.01) |
| ***A62B 18/02*** | (2006.01) |
| ***A62B 19/02*** | (2006.01) |
| ***A62B 18/00*** | (2006.01) |
| *A62B 19/00* | (2006.01) |

(52) U.S. Cl.
CPC ..... *A62B 18/02* (2013.01); *A62B 19/02* (2013.01); *A62B 23/02* (2013.01); *A62B 19/00* (2013.01)

(58) Field of Classification Search
CPC ..... A62B 23/02; A62B 9/003; A62B 23/025; A62B 18/006; A62B 19/02
See application file for complete search history.

(56) References Cited

U.S. PATENT DOCUMENTS

| | | | | | |
|---|---|---|---|---|---|
| 4,793,343 | A * | 12/1988 | Cummins, Jr. | ... | A61M 16/1075 128/203.27 |
| 5,036,844 | A * | 8/1991 | Pouchot | ..... | A62B 23/02 128/201.25 |
| 6,349,721 | B1 * | 2/2002 | Grilliot | ..... | A62B 23/02 128/201.29 |
| 2006/0231100 | A1 * | 10/2006 | Walker | ..... | A61M 16/08 128/205.25 |
| 2007/0044800 | A1 | 3/2007 | Church et al. | | |
| 2010/0132706 | A1 * | 6/2010 | Nashed | ..... | A61M 16/0078 128/203.28 |
| 2013/0004376 | A1 * | 1/2013 | Ryou | ..... | A61L 9/16 422/120 |

FOREIGN PATENT DOCUMENTS

| | | | | | |
|---|---|---|---|---|---|
| JP | 2008-295993 | A | 12/2008 | | |
| JP | 2015526125 | A | 9/2015 | | |
| KR | 20-0154880 | Y1 | 8/1999 | | |
| KR | 101332199 | B1 | 11/2013 | | |
| WO | WO 2011112031 | A2 * | 9/2011 | ..... | A61L 9/16 |
| WO | 2013/191468 | A1 | 12/2013 | | |

* cited by examiner

PORTABLE AIR PURIFIER

This application is a National Stage entry from International Application No. PCT/KR2013/005411, filed Jun. 19, 2013, which claims priorities to and the benefit of Korean Patent Application No. 10-2012-0066578, filed Jun. 21, 2012, the disclosure of which is incorporated herein by reference in its entirety.

TECHNICAL FIELD

This invention relates generally to a portable air purifier and, more particularly, to a portable air purifier having an air purification part removing noxious gases in the air using a noble metal catalyst.

BACKGROUND ART

Typically, gas masks are used to minimize human casualties caused by an attack of chemical weapons from the enemy in wartime. As illustrated in FIG. 1, a gas mask 100 has a structure in which noxious gases flowing in from the outside are removed by a canister 110 attached thereto so as to enable a wearer to inhale innoxious air only. Multipurpose gas masks for minimizing human casualties resulting from various noxious gases occurring in a war as well as a fire have recently been released in the market.

The canister 110 used in the gas mask 100 includes an absorbent such as activated carbon that chemically adsorbs or decomposes the noxious gases, and filter paper that physically filters particulate substances, and can thus remove the noxious gases in a chemical/physical way.

However, due to the restriction of a physical size of the canister 110, one canister 110 is restricted in capacity capable of removing the noxious gases. As such, when the gas mask is used in prolonged exposure to the noxious gases, an extra canister must be prepared.

If a purifying function of the canister 110 attached to the gas mask 100 is lost without the extra canister, the noxious gases flow into the gas mask 100, and thus a wearer who wears the gas mask 100 may fall into a dangerous situation.

SUMMARY OF INVENTION

Technical Problem

The present invention has been made to solve the above problems, and an object of the present invention is to provide a portable air purifier capable of removing noxious gases using a filter part that decomposes noxious gases included in external air with a metal catalyst layer heated to a predetermined temperature condition and has a semi-permanent service life.

Solution to Problem

To achieve the object, there is provided a portable air purifier, which includes: a mask part; a first connecting hose, one end of which is connected to the mask part; a second connecting hose in which the first connecting hose is installed and at least part of which has an opening for introducing external air; an air purification module having a case, an external air inflow part that is connected to one end of the second connecting hose and introduces the external air through the second connecting hose into the case, a filter part that is disposed in the case, has a metal catalyst layer, and purifies the external air introduced into the case after being heated to a predetermined temperature condition, at least one heater that is disposed in the case and heats the filter part to the predetermined temperature condition for a catalytic reaction of the filter part, and a purified air outflow part that is connected to the other end of the first connecting hose and discharges the purified air passing through the filter part to the first connecting hose; and a power supply unit configured to supply power to the heater.

Here, the filter part may allow the external air introduced from the external air inflow part to pass therethrough and include an inorganic thin film having numerous pores formed on a surface thereof, and a catalyst mother liquid may be carried on a part or whole of the inorganic thin film so as to form a metal catalyst layer.

Further, the purified air outflow part may include a fan installed therein.

Further, the second connecting hose may be a metal bellows.

In addition, the portable air purifier may further include a canister that is attached to the mask part, purifies the external air, and introduces the purified air into the mask part.

Advantageous Effects of Invention

According to the portable air purifier of the present invention, since the filter part for removing poisonous gases or biochemical pollutants through a catalytic reaction of a metal catalyst layer can be semi-permanently used, the conventional inconvenience of carrying an extra canister is removed.

Further, the portable air purifier need not provide a separate cooling means for cooling purified air in a high temperature state, because a thermal equilibrium state between the purified air and the external air can be maintained to reduce a temperature of the purified air in the high temperature state by a structure in which the first connecting hose delivering the purified air to the mask part is installed inside the second connecting hose introducing the external air.

DETAILED DESCRIPTION OF EMBODIMENT

The following detailed descriptions of the invention will be made with reference to the accompanying drawings illustrating specific embodiments of the invention by way of example. These embodiments will be described in detail such that the invention can be carried out by those skilled in the art. It should be understood that various embodiments of the invention are different, but are not necessarily mutually exclusive. For example, a specific shape, structure, and characteristic of an embodiment described herein may be implemented in another embodiment without departing from the scope and spirit of the invention. In addition, it should be understood that a position or an arrangement of each component in each disclosed embodiment may be changed without departing from the scope and spirit of the invention. Accordingly, there is no intent to limit the invention to the detailed descriptions to be described below. The scope of the invention is defined by the appended claims and encompasses all equivalents that fall within the scope of the appended claims. Like numbers refer to the same or like functions throughout the description of the figures.

Hereinafter, in order to enable those skilled in the art to easily carry out the invention, exemplary embodiments of the invention will be described in detail with reference to the accompanying drawings.

Figure 1:
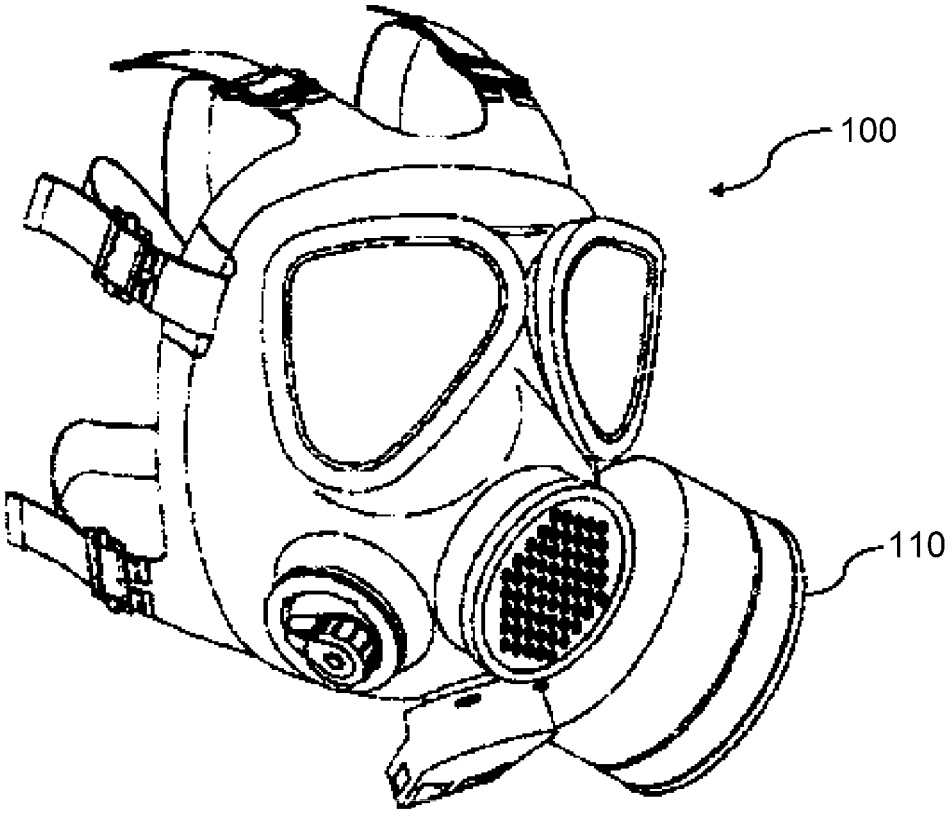
FIG. 1 Prior Art
FIG. 1 illustrates a conventional gas mask.
Figure 2:
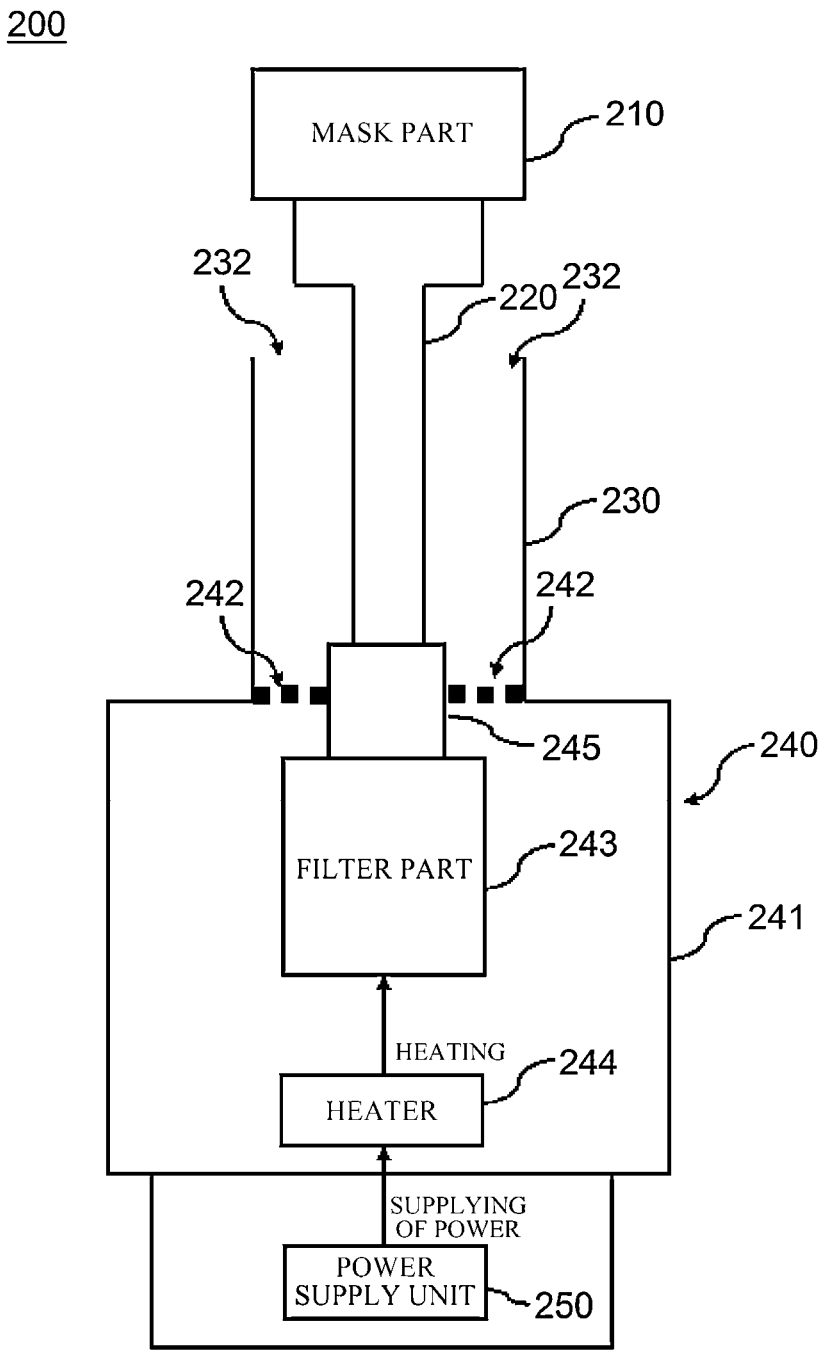
FIG. 2 schematically illustrates a portable air purifier according to an embodiment of the present invention.

FIG. 2 is a schematic block diagram illustrating a configuration of a portable air purifier according to an embodiment of the present invention.

A portable air purifier 200 according to an embodiment of the present invention includes a mask part 210, a first connecting hose 220, a second connecting hose 230, an air purification module 240, and a power supply unit 250.

The mask part 210 is formed in such a shape as to seal all or part of the face so as to allow the respiratory organs of a user who uses the portable air purifier 200 to be isolated from the outside.

The first connecting hose 220 has one end connected to the mask part 210, and the other end connected to a purified air outflow part 245 of the air purification module 240 to be described below. In the embodiment of the present invention, the first connecting hose 220 delivers purified air discharged through the purified air outflow part 245 into the mask part 210.

The first connecting hose 220 is housed in the second connecting hose 230, at least part of which is provided with an opening 232 for introducing external air.

In the embodiment of the present invention, the second connecting hose 230 introduces the external air through the opening 232 as in FIG. 2, and delivers the introduced external air to an external air inflow part 242 of the air purification module 240 to be described below.

The air purification module 240 includes a case 241, the external air inflow part 242 that is connected to one end of the second connecting hose 230 and introduces the external air through the second connecting hose 230 into the case 241, a filter part 243 that is disposed in the case 241, is formed with a metal catalyst layer, and purifies the external air introduced into the case 241 after being heated to a predetermined temperature condition, at least one heater 244 that is disposed in the case 241 and heats the filter part 243 to the predetermined temperature condition for the purpose of a catalytic reaction at the filter part 243, and the purified air outflow part 245 that is connected to the other end of the first connecting hose 220 and discharges the purified air passing through the filter part 243 to the first connecting hose 220.

Hereinafter, the filter part 243 of the air purification module 240 will be described in detail.

Figure 3:
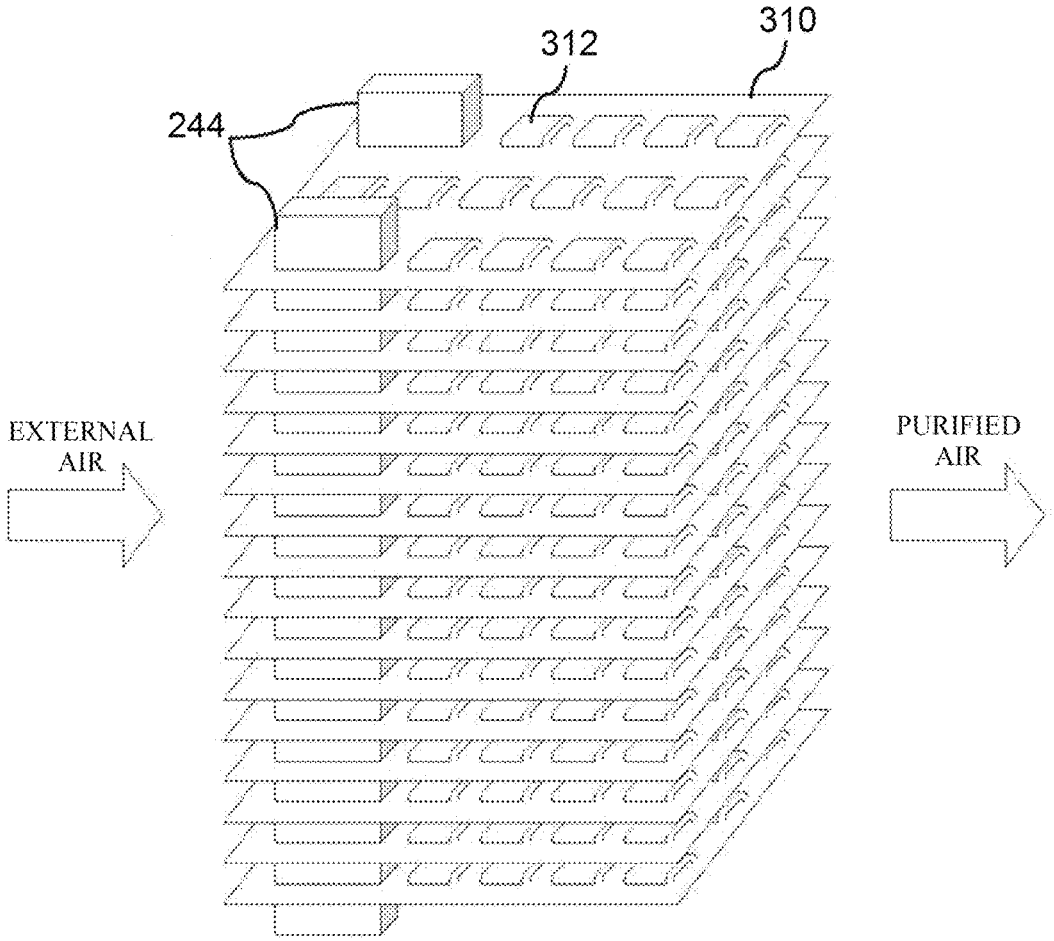
FIG. 3 illustrates filter and heater parts according to an embodiment of the present invention.

Referring to FIG. 3, the filter part 243 of the air purification module 240 may be configured to stack numerous filter plates 310 at intervals such that air flows between the filter plates 310. The filter plates 310 are each provided with numerous vents 312 so as to increase a contact area when the air goes past, so that the catalytic reaction can be more effectively caused. Further, each heater 244 is shaped of a rod, and may be configured to be interposed between the filter plates 310 and to be joined with the filter plates 310. The heaters 244 may each employ a positive temperature coefficient (PTC) heater, and the number of heaters 244 may be adjusted depending on a width of each filter plate 310 and the number of filter plates 310.

Meanwhile, the filter part 243 is shaped of a tube such as a cylinder that a gas can pass through the tube. Alternatively, the filter part 243 may be rolled in a spiral shape so as to enable ventilation. In this way, the filter part 243 may be formed in various structures, and thus is not limited to its shape. If the filter part 243 is configured to enable ventilation, this should be understood to fall into the technical idea of the present invention.

Meanwhile, in the embodiment of the present invention, an inorganic thin film containing numerous pores is formed on a surface of the filter part 243 by an anodizing reaction, and a catalyst mother liquid is carried on the inorganic thin film so as to form a metal catalyst layer. A process of growing a thin film of an oxide or a nitride formed on a metal surface can be carried out using an electrolytic reaction during the anodizing reaction.

When direct current flows through an electrolytic solution, hydrogen is generated from a cathode metal, and oxygen is generated from an anode metal (e.g., a metal such as an aluminum (Al) alloy, titanium (Ti), zinc (Zn), magnesium (Mg), or niobium (Nb)). The generated oxygen reacts with the anode metal, forming a metal oxide thin film. In this process, the electrolytic solution minutely dissolves the generated oxide thin film. In this case, if a dissolution rate and a formation rate of the oxide thin film are balanced, numerous pores having a diameter of 10 to 150 nm are formed on the anode metal surface. When the pores are formed, the electrolytic solution and the electric current can come into contact with a metal matrix under the oxide thin film. As a result, a still thicker thin film than the oxide thin film formed by the spontaneous oxidizing reaction of the metal can be formed. The thin film formed in this process has various physical properties according to process conditions. As a low concentration of electrolytic solution and a high intensity of current or voltage are used, the thin film becomes thick. The oxide thin film formed by the method as described above can be used as the inorganic thin film of the filter part 243.

To be more specific, the inorganic thin film may be formed using a conductive metal such as aluminum. When the anodizing reaction is carried out using the aluminum as the anode, alumina (aluminum oxide) is gradually stacked, and the alumina thin film formed in this way can be used as the inorganic thin film of the present invention. Afterwards, a metal catalyst layer of platinum (Pt) or rhodium (Rh) may be inserted between the pores of the inorganic thin film. The metal catalyst layer is formed by carrying the catalyst mother liquid, and is then dried.

Figure 4:
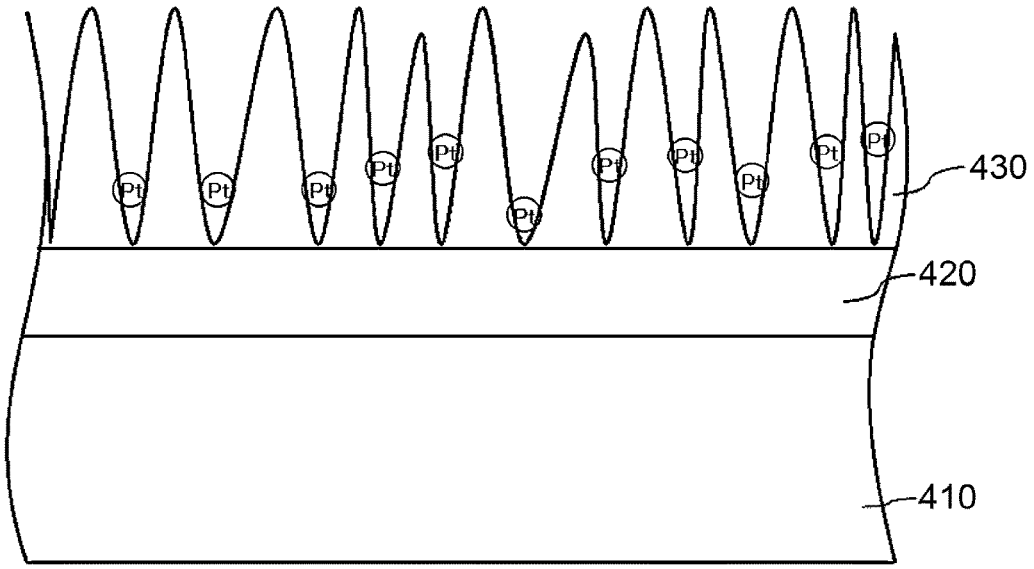
FIG. 4 illustrates a cross section of a filter plate according to an embodiment of the present invention.

Referring to FIG. 4, there is shown a cross-sectional structure in which a metal layer 410 that is a base of the filter part 243, a transition layer 420 in which a metal making up the metal layer 410 and an oxide of the metal coexist on the metal layer 410, and an inorganic thin film 430 formed on the transition layer 420 are formed. A platinum (Pt) catalyst that is an example of the metal catalyst layer may be attached to surfaces of the numerous pores included in the inorganic thin film 430.

In the embodiment of the present invention, when air passes the filter part 243 which is heated to a temperature of 200 to 250° C., components of the noxious gases included in the external air cause a catalytic reaction with the metal catalyst layer of the filter part 243, and are removed. Furthermore, biochemical pollutants are chemically burnt and removed by the catalytic reaction.

Meanwhile, as described above, since the filter part 243 purifies the external air after being heated to the predetermined temperature condition by the heater 244, the air purified by passing through the filter part 243 has a higher temperature than room temperature.

In this way, the purified air in the high temperature state is continuously maintained at a high temperature even when it is discharged to the first connecting hose 220 through the purified air outflow part 245. If a user of the portable air purifier inhales this purified air in the high temperature state, the user may suffer dyspnea. As such, preferably, a separate cooling means is provided outside the first connecting hose 220, and cools a surface of the first connecting hose 220, thereby cooling the purified air of the high temperature to the room temperature.

However, if a separate cooling means is additionally provided, portability of the portable air purifier 200 can be reduced.

For this reason, the present invention employs a structure in which the first connecting hose 220 is installed inside the second connecting hose 230, and the external air is introduced into the external air inflow part 242 of the air purification module 240 via the opening 232 of the second connecting hose 230 and simultaneously comes into contact with the surface of the first connecting hose 220 so as to cool the surface of the first connecting hose 220.

Detailed description of the structure will be made below.

Figure 5:
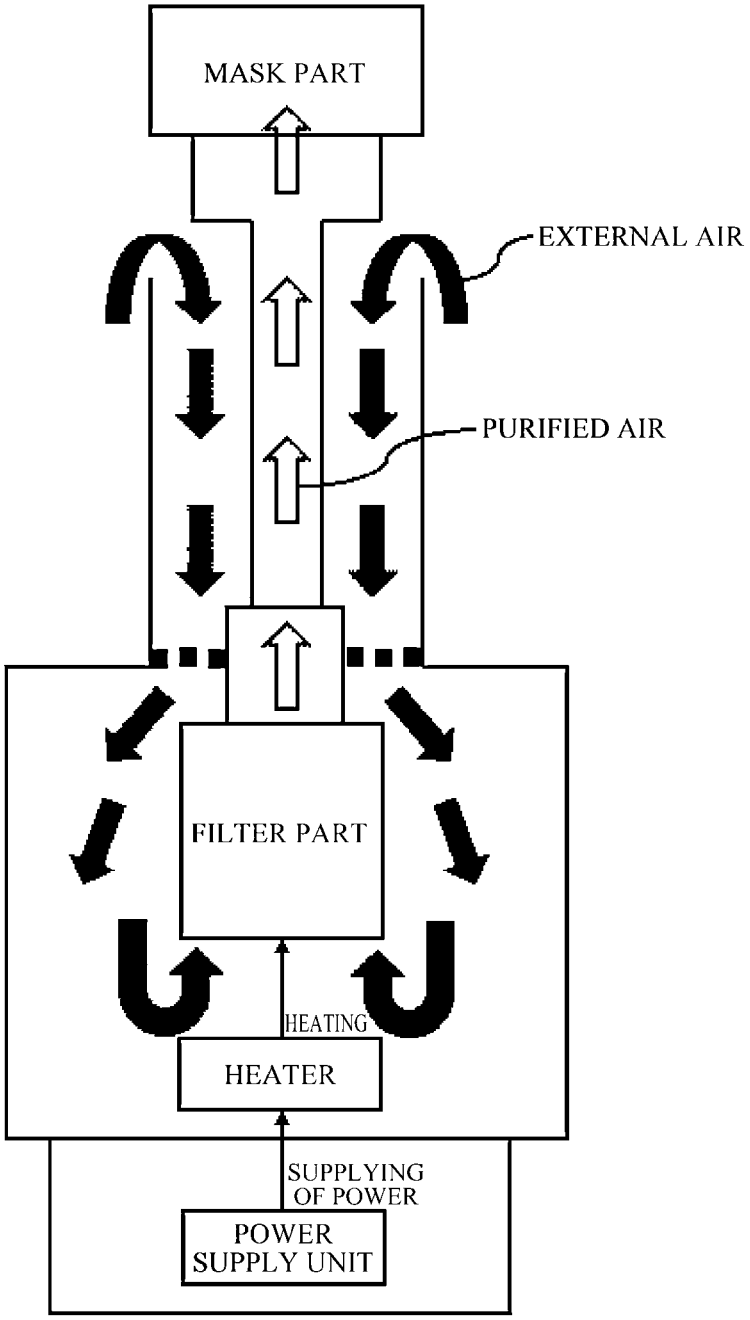
FIG. 5 illustrates an air purifying process of the portable air purifier according to the embodiment of the present invention.

FIG. 5 illustrates an air purifying process of the portable air purifier according to the embodiment of the present invention.

A user of the portable air purifier puts the mask part 210 of the portable air purifier 200 on his/her own face in an environment in which external air including noxious gases or biochemical pollutants are present at room temperature, and draws a breath. Then, the external air is introduced through the opening 232 formed in the second connecting hose 230, comes into contact with an outer surface of the first connecting hose 220 installed inside the second connecting hose 230, and is introduced into the case 241 through the external air inflow part 242 of the air purification module 240.

The external air introduced into the case passes through the filter part 243 heated to a predetermined temperature condition by the heater 244. Thereby, the noxious gases or the biochemical pollutants are removed, and the external air becomes purified air whose temperature is raised from room temperature to a high temperature, namely, purified air in a high temperature state.

Such purified air in the high temperature state is discharged to the first connecting hose 220 through the purified air outflow part 245, and moves to the mask part 210 while coming into contact with an inner surface of the first connecting hose 220. In this case, since the outer surface of the first connecting hose 220 is in contact with the external air in the room temperature state, heat conduction occurs between the inner and outer surfaces of the first connecting hose 220, and heat of the purified air moves from the inner surface of the first connecting hose 220 to the external air introduced into the second connecting hose 230 via the outer surface of the first connecting hose 220.

As a result, the purified air in the high temperature state and the external air in the room temperature state maintain a thermal equilibrium state at a predetermined temperature, and the temperature of the purified air is lowered to such a level that the user of the portable air purifier does not suffer inconvenience when inhaling the purified air. Here, a thermal equilibrium temperature between the purified air and the external air can be obtained by adjusting lengths of the first and second connecting hoses 220 and 230. Further, the first connecting hose 220 is preferably a metal or plastic bellows having high conductivity. When the length of the first connecting hose 220 is increased to adjust the thermal equilibrium temperature, a fan may be additionally installed inside the purified air outflow part 245 to smoothly discharge the purified air.

The power supply unit 250 supplies power to the heater 244 for heating the filter part 243. Here, the power supply unit 250 may be one selected from an air-zinc battery, a lithium-ion battery, a manganese battery, an alkaline battery, or a fuel cell.

Meanwhile, when the power supply unit 250 is replaced, the air purification module 240 is not operated, and the portable air purifier 200 according to the embodiment of the present loses an air purification function. As such, when the power supply unit 250 is replaced, the user of the portable air purifier may inhale the noxious gases included in the external air. To prevent this, preferably, a canister (not shown) for removing the noxious gases included in the external air to introduce it into the mask part 210 is attached to the mask part 210, and replaces the air purification module 240 to purify the external air while the power supply unit 250 is replaced.

As described above, the portable air purifier 200 according to the embodiment of the present need not provide the separate cooling means for cooling the purified air in the high temperature state, because the filter part 243 for removing the noxious gases or the biochemical pollutants based on the catalytic reaction of the metal catalyst layer can be semi-permanently used, and because the thermal equilibrium state between the purified air and the external air can be maintained to reduce the temperature of the purified air in the high temperature state by the structure in which the first connecting hose 220 is installed inside the second connecting hose 230.

Although the invention has been described with the particulars such as specific components, the limited embodiments, and the drawings, which are provided only to help comprehensive understanding of the invention, it is obvious to those skilled in the art that the invention is not limited to the embodiments and various changes and modifications in form and details may be made without departing from the spirit and scope of the invention.

Accordingly, the idea of the invention should not be determined by the aforementioned embodiments, and the following claims as well as all modifications or variations belonging to the equivalents of the claims will be within the scope of the invention.

What is claimed is:

1. A portable air purifier comprising:

a mask part;

a first connecting hose, one end of which is connected to the mask part;

a second connecting hose in which the first connecting hose is installed, and one end of the mask part side of which has an opening for introducing external air;

an air purification module having a case, an external air inflow part that is connected to the other end of the second connecting hose and introduces the external air through the second connecting hose into the case, a filter part that is disposed in the case, has a metal catalyst layer, and purifies the external air introduced into the case after being heated to a predetermined temperature condition, at least one heater that is disposed in the case and heats the filter part to the predetermined temperature condition for a catalytic reaction of the filter part, and a purified air outflow part that is connected to the other end of the first connecting hose and discharges the purified air passing through the filter part in a direction opposite to a direction of the external air introduced to the second connecting hose to the first connecting hose; and a power supply unit configured to supply power to the heater.

2. The portable air purifier according to claim 1, wherein the filter part allows the external air introduced from the external air inflow part to pass therethrough and includes an inorganic thin film having numerous pores formed on a surface thereof, and a catalyst mother liquid is carried on a part or whole of the inorganic thin film so as to form the metal catalyst layer.

3. The portable air purifier according to claim 1, wherein the purified air outflow part includes a fan installed therein.

4. The portable air purifier according to claim 1, wherein the second connecting hose is a metal bellows.

5. The portable air purifier according to claim 1, further comprising a canister that is attached to the mask part, purifies the external air, and introduces the purified air into the mask part.

* * * * *